US007295192B2

(12) United States Patent
Hu

(10) Patent No.: US 7,295,192 B2
(45) Date of Patent: Nov. 13, 2007

(54) COMPENSATING COLOR SHIFT OF ELECTRO-LUMINESCENT DISPLAYS

(75) Inventor: Shuo-Hsiu Hu, Tainan (TW)

(73) Assignee: Au Optronics Corporation, Hsinchu (TW)

( * ) Notice: Subject to any disclaimer, the term of this patent is extended or adjusted under 35 U.S.C. 154(b) by 718 days.

(21) Appl. No.: 10/838,421

(22) Filed: May 4, 2004

(65) Prior Publication Data

US 2005/0248513 A1 Nov. 10, 2005

(51) Int. Cl.
*G09G 3/30* (2006.01)

(52) U.S. Cl. ..... 345/176; 345/77; 345/78; 345/36

(58) Field of Classification Search ..... 345/76, 345/77, 78, 36

See application file for complete search history.

(56) References Cited

U.S. PATENT DOCUMENTS

| | | | | |
|---|---|---|---|---|
| 5,517,278 | A | 5/1996 | Takahara et al. | |
| 6,351,077 | B1 | 2/2002 | Koyama | |
| 6,384,804 | B1 | 5/2002 | Dodabalapur et al. | |
| 6,583,577 | B1 | 6/2003 | Choi et al. | |
| 2003/0184238 | A1 | 10/2003 | Osame et al. | |
| 2003/0193298 | A1 | 10/2003 | Okada et al. | |
| 2003/0193513 | A1 | 10/2003 | Miyazawa | |
| 2004/0070558 | A1* | 4/2004 | Cok et al. | 345/76 |
| 2006/0119552 | A1* | 6/2006 | Yumoto | 345/76 |

FOREIGN PATENT DOCUMENTS

| | | |
|---|---|---|
| JP | 10-289785 | 10/1998 |

* cited by examiner

*Primary Examiner*—Richard Hjerpe
*Assistant Examiner*—Leonid Shapiro
(74) *Attorney, Agent, or Firm*—Duane Morris, LLP

(57) ABSTRACT

An electro-luminescent display comprises a plurality of scanning lines, a plurality of data lines which are arranged to cross the plurality of scanning lines and forming a plurality of pixel regions, at least one indicating driving circuit, and at least one indicating electro-luminescent device. Each of the pixel regions includes a switching circuit, a pixel driving circuit, and a pixel electro-luminescent device having a color type. The switching circuit is electrically connected to a respective one of the scanning lines and a respective one of the data lines. The pixel electro-luminescent devices electrically connected to one of the data lines have the same color type as each other. The indicating driving circuit, distinct from the pixel driving circuits, is electrically connected to the one data line and is controlled by a signal thereon. The indicating electro-luminescent device is electrically connected to and is driven by the indicating driving circuit and having the same color type as the pixel electro-luminescent device electrically connected to the one data line.

20 Claims, 6 Drawing Sheets

COMPENSATING COLOR SHIFT OF ELECTRO-LUMINESCENT DISPLAYS

FIELD OF THE INVENTION

The present invention relates to electro-luminescent displays, and more particularly to compensating color shift of electro-luminescent displays and a method therefor.

BACKGROUND

Technology of flat display has been significantly advanced recently, in part because manufacturing thin film transistors on a substrate such as glass has become a mature skill which facilitates the development of active matrix type display devices. In addition to liquid crystal materials which need a backlight when used for flat displays, an electro-luminescent device, such as an organic light emitting diode (OLED), which can emit light itself, is actively researched. Because of the feature of self-light-emitting, among many other advantages, the display comprising electro-luminescent devices is brighter than a backlight display.

However, the brightness of the electro-luminescent device may decay over the time of usage. Moreover, the electro-luminescent devices of different colors may have different rates of brightness decay. For example, the blue light electro-luminescent device decays faster than the other colors. As a result, the CIE standard observer curve value of the electro-luminescent display shifts, and the color presented on the electro-luminescent display shifts toward yellow. This effect is called "color shift" in the display because the brightness of red, green, and blue color are no longer as even as designed.

SUMMARY OF THE INVENTION

An electro-luminescent display comprises a plurality of scanning lines, a plurality of data lines which are arranged to cross the plurality of scanning lines and forming a plurality of pixel regions, at least one indicating driving circuit, and at least one indicating electro-luminescent device. Each of the pixel regions includes a switching circuit, a pixel driving circuit, and a pixel electro-luminescent device having a color type. The switching circuit is electrically connected to a respective one of the scanning lines and a respective one of the data lines. The pixel electro-luminescent devices electrically connected to one of the data lines have the same color type as each other. The indicating driving circuit, distinct from the pixel driving circuits, is electrically connected to the one data line and is controlled by a signal thereon. The indicating electro-luminescent device is electrically connected to and is driven by the indicating driving circuit and has the same color type as the pixel electro-luminescent device electrically connected to the one data line.

A method to compensate color-shift in an electro-luminescent display, which has a plurality of pixel electro-luminescent devices, comprises: providing an indicating driving circuit, distinct from the pixel driving circuits, electrically connected to a data line; providing an indicating electro-luminescent device, distinct from the pixel electro-luminescent devices, electrically connected to the indicating driving circuit; and driving the indicating electro-luminescent device when any of the pixel electro-luminescent devices electrically connected to the data line is driven.

BRIEF DESCRIPTION OF THE DRAWINGS

A more complete understanding of the present invention can be obtained by reference to the detailed description of embodiments in conjunction with the accompanying drawings, in which.

DETAILED DESCRIPTION

Figure 1:
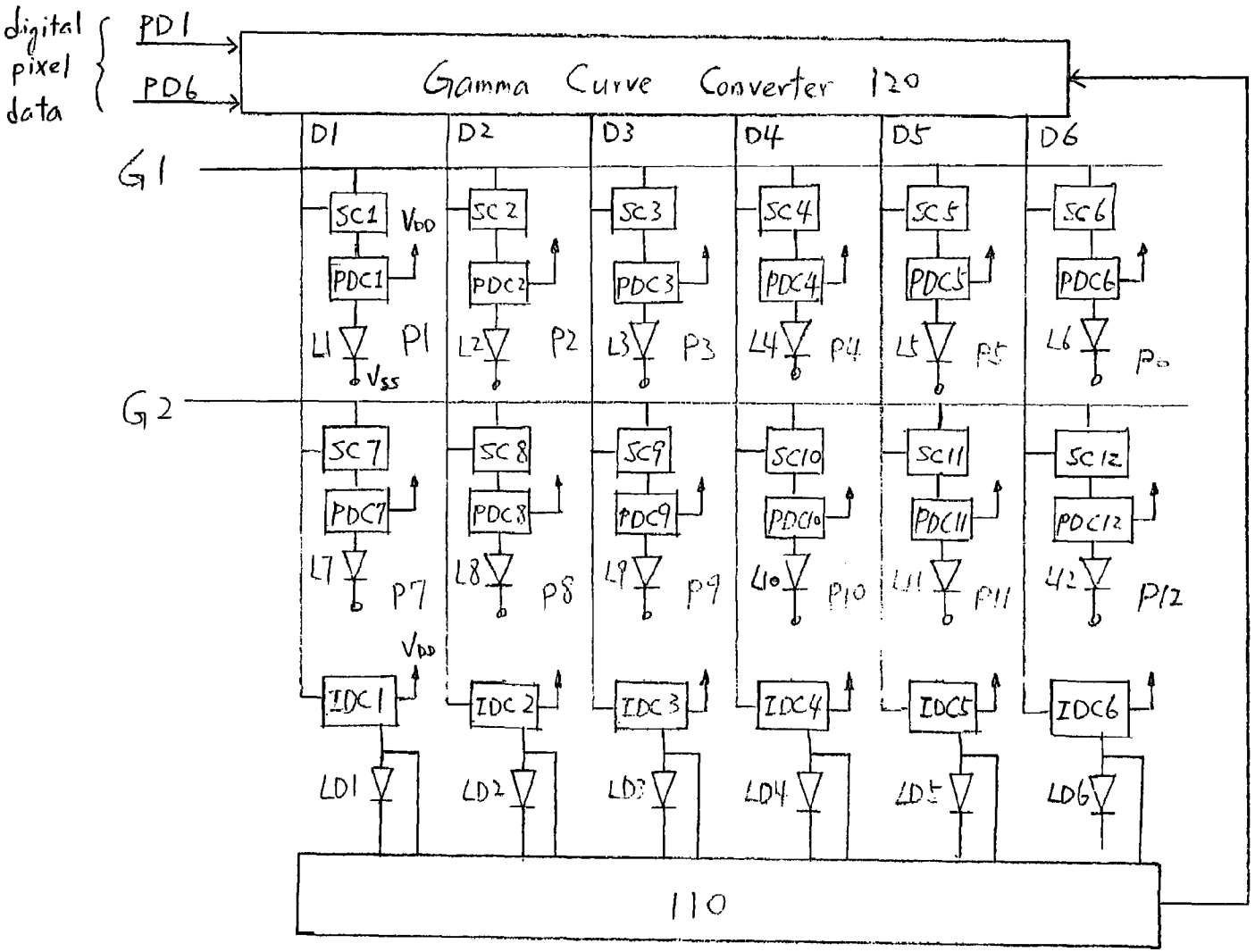
FIG. 1 illustrates an exemplary embodiment of an electro-luminescent display for compensating color shift.

As shown in FIG. 1, an exemplary embodiment of an electro-luminescent display comprises a plurality of scanning lines G1 and G2, a plurality of data lines D1-D6 crossing scanning lines to form a plurality of pixel regions P1-P12, a plurality of switching circuits SC1-SC12, a plurality of pixel driving circuits PDC1-PDC12, a plurality of pixel electro-luminescent devices L1-L12, a plurality of indicating driving circuits IDC1-IDC6, and a plurality of indicating electro-luminescent devices LD1-LD6. Each data line connects to the pixel electro-luminescent devices and the indicating electro-luminescent devices of the same color.

Each pixel region of P1-P12 includes a corresponding switching circuit from SC1-SC12, a corresponding pixel driving circuit from PDC1-PDC12, a corresponding pixel electro-luminescent device from L1-L12. The pixel electro-luminescent devices L1-L12 can be red, green, or blue color type. The switching circuits SC1-SC12 are electrically connected to scanning lines G1 and G2, data lines D1-D6, and pixel driving circuits PDC1-PDC12 respectively. The pixel driving circuits PDC1-PDC12 are electrically connected to switching circuits SC1-SC12, power supply lines VDD, and pixel electro-luminescent devices L1-L12 respectively. A switching circuit and a corresponding pixel driving circuit can drive a corresponding pixel electro-luminescent device by voltage or by current.

The data line D1-D6 are electrically connected to the indicating driving circuits IDC1-IDC6 respectively. The indicating driving circuits IDC1-IDC6 are electrically connected to the indicating electro-luminescent devices LD1-LD6, respectively. When the scanning line G1 is on, both the pixel electro-luminescent device L1 and the indicating electro-luminescent device LD1 are driven by the data signal from the data line D1 and emit lights with brightness corresponding to the data signal. When the scanning line G2 is on, both the pixel electro-luminescent device L7 and the indicating electro-luminescent device LD1 are driven by the data signal from the data line D1 and emit lights with brightness corresponding to the data signal. As a result, the total amount of time that the indicating electro-luminescent device LD1 is driven reflects the total usage time of all pixel electro-luminescent devices, such as L1 and L7, which are electrically connected to the same data line D1.

The brightness of the pixel electro-luminescent devices may decrease over the total time of usage, which is also reflected in the increase of cross voltage between an anode and cathode of the pixel electro-luminescent devices. In other words, the longer a pixel electro-luminescent device is used, the larger the cross voltage becomes and the less bright the pixel electro-luminescent device becomes. The same phenomena apply to the indicating electro-luminescent devices.

The indicating electro-luminescent device is driven whenever a pixel electro-luminescent device connected to the corresponding data line is driven to emit light. As a result, the time the indicating electro-luminescent device is used is the sum of the time every pixel electro-luminescent device electrically connected to the same data line is used. The longer the indicating electro-luminescent device is used, the less bright the indicating electro-luminescent device is; correspondingly the cross voltage between the anode and cathode of the indicating electro-luminescent device becomes larger. By detecting the increase of the cross voltage of the indicating electro-luminescent device, the total reduction of the brightness of the pixel electro-luminescent devices electrically connected to the same data can be measured.

As shown in FIG. 1, the anodes and cathodes of the indicating electro-luminescent devices are electrically connected to a color-shift compensation unit 110. The cross voltages of the indicating electro-luminescent devices are detected. If the increase of the cross voltage reached a predetermined value, a corresponding gamma curve is adjusted. For example, an original cross voltage is 6V and a detected cross voltage after certain time of use becomes 6.7V. If the predetermined threshold value is a 10% increase, a gamma curve is adjusted because the increase of the cross voltage exceeds the predetermined value.

In order for the pixel electro-luminescent devices L1-L12 to present intended gray levels of brightness, a gamma curve converter 120 transforms digital pixel data PD1-PD6 to appropriate analog pixel data (analog voltage signals) which are transmitted onto the data lines D1-D6. In other words, the gamma curve converter 120 provides analog pixel data which drive the pixel electro-luminescent devices L1-L12 to emit light at a gray level corresponding to digital pixel data. After the pixel electro-luminescent devices decay over time, the brightness of the pixel electro-luminescent device driven by a specific digital pixel datum, however, also decreases. By adjusting the gamma curve in the color-shift compensation unit 110, specific digital pixel data are transformed to higher or lower corresponding analog pixel data, which compensates for the decay of brightness, and the pixel electro-luminescent device is driven to the intended brightness.

The pixel electro-luminescent devices of different colors such as red, blue, and green, may have different extents of brightness decay after a specific period of usage, which causes the color shift effect. By adjusting the gamma curves of different colors, the color shift effect can be diminished or compensated.

Figure 2:
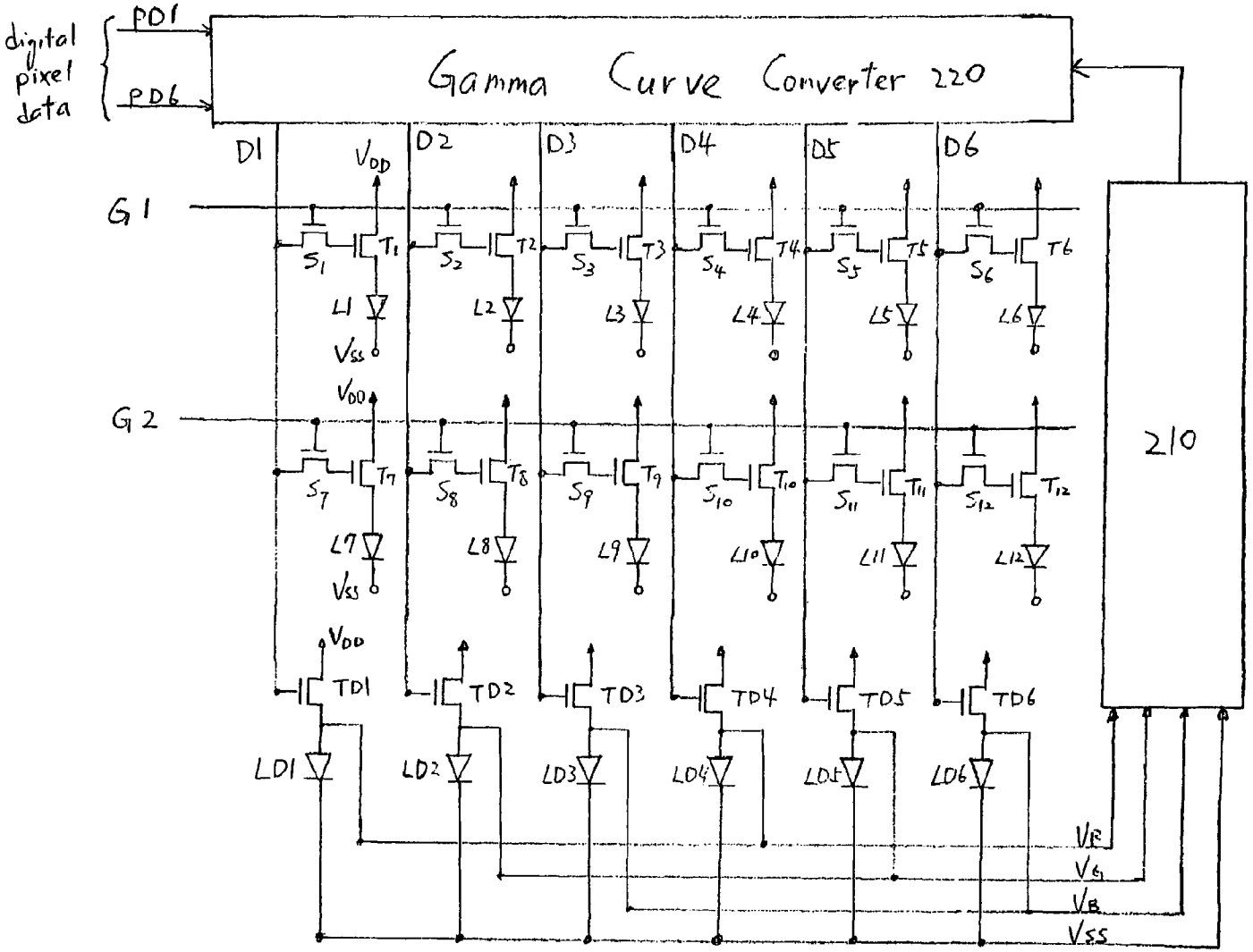
FIG. 2 illustrates an exemplary embodiment of an electro-luminescent display with pixel electro-luminescent devices driven by voltage.

As mentioned above, the switching circuit and the corresponding pixel driving circuit together can drive the corresponding pixel electro-luminescent device by voltage. FIG. 2 shows an exemplary embodiment, in which the pixel electro-luminescent device is driven by voltage. In FIG. 2, each of the switching circuits comprises a switching device from S1-S12. Each of the pixel driving circuits comprises a pixel driving device from T1-T12.

The switching devices S1-S12 can be thin film transistors (TFT) as shown in this embodiment or other electronic components which function as electronic switches. A gate of the switching devices S1-S12 is electrically connected to a scanning line. For example, the gate of switching device S1 is electrically connected to the scanning line G1. A source of the switching devices S1-S12 is electrically connected to a data line. A drain of the switching devices S1-S12 is electrically connected to a driving device. For example, the source of the switching device S1 is electrically connected to the data line D1. And the drain of the switching device S1 is electrically connected to the driving device T1. Because a source and a drain of a switching device—a TFT in this embodiment—are the same symmetric structure, the connections to a source and a drain can be exchanged.

The pixel driving devices T1-T12 are p-type MOS thin film transistors (TFTs) in this embodiment. However, a skilled artisan will understand that other types of TFTs such as n-type MOS TFTs, or other electronic components which function to drive pixel electro-luminescent devices can be used. A gate of the pixel driving devices is electrically connected to a switching device. For example, the gate of pixel driving device T1 is electrically connected to the switching device. A source of the pixel driving devices is electrically connected to a power supply line. A drain of the pixel driving devices is electrically connected to a pixel electro-luminescent device. For example, the source of the pixel driving device T1 is electrically connected to the power supply line VDD. And the drain of the pixel driving device T1 is electrically connected to the pixel electro-luminescent device L1. When n-type MOS TFTs are used for the pixel driving devices, a drain of the n-type MOS TFT is electrically connected to a power supply line and a source is electrically connected to a pixel electro-luminescent device.

The pixel electro-luminescent devices L1-L12 are organic light emitting diodes (OLEDs) in this embodiment. However, a skilled artisan will understand that other electronic components which function to emit light can be used. The anode of a pixel electro-luminescent device is electrically connected to the pixel driving device. The cathode of the pixel electro-luminescent device is electrically connected to a common electrode such as a ground. For example, the anode of the pixel electro-luminescent device L1 is electrically connected to the pixel driving device T1. And the cathode of the pixel electro-luminescent device L1 is electrically connected to a common electrode VS1. In this embodiment, L1, L4, L7, and L10 are red light OLEDs; L2, L5, L8, and L11 are green light OLEDs; L3, L6, L9, and L12 are blue light OLEDs.

The indicating driving devices TD1-TD6 are p-type MOS thin film transistors (TFTs) in this embodiment. However, a skilled artisan will understand that other type of TFTs such as n-type MOS TFTs, or other electronic components which function to drive indicating electro-luminescent devices can be used. A gate of the indicating driving device is electrically connected to a data line. For example, the gate of the indicating driving device TD1 is electrically connected to the data line D1. A source of the indicating device is electrically connected to a power supply line. A drain of the indicating driving device is electrically connected to the indicating electro-luminescent device. For example, the source of an indicating driving device TD1 is electrically connected to the power supply line VDD. And the drain of the indicating driving device TD1 is electrically connected to the indicating electro-luminescent device LD1. When n-type MOS TFTs are used for the indicating driving devices, a drain is electrically connected to a power supply line and a source is electrically connected to an indicating electro-luminescent device.

The indicating electro-luminescent devices LD1-LD6 are organic light emitting diodes (OLEDs) in this embodiment. However, a skilled artisan will understand that other electronic components which function to emit lights can be used. An anode of the indicating electro-luminescent device is electrically connected to the indicating driving device. A cathode of the indicating electro-luminescent device is electrically connected to a common electrode. For example, the anode of the indicating electro-luminescent device LD1 is electrically connected to the indicating driving device TD1. And the cathode of the indicating electro-luminescent device LD1 is electrically connected to the common electrode VS1. In this embodiment, LD1 and LD4 are red light OLEDs; LD2 and LD5 are green light OLEDs; LD3 and LD6 are blue light OLEDs.

The cross voltages of the indicating electro-luminescent devices are received by a color-shift compensation unit 210. The anodes of the indicating electro-luminescent devices LD1 and LD4 are electrically connected to be the anode voltage VR of red light indicating electro-luminescent devices. The voltage difference between anode voltage VR and the common cathode voltage VSS reflects the extent of total red light brightness decrease of the pixel electro-luminescent devices electrically connected to the data lines D1 and D4. In the color-shift compensation unit 210, the gamma curve of red light pixel electro-luminescent devices is then adjusted accordingly to compensate for the color shift effect. The anodes of the indicating electro-luminescent devices LD2 and LD5 are electrically connected to be the anode voltage VG of green light indicating electro-luminescent devices. The gamma curve of green light pixel electro-luminescent devices is then adjusted based on the cross voltage between the anode voltage VG and the common cathode voltage VSS, which reflects the total green light brightness decrease of the pixel electro-luminescent devices electrically connected to the data lines D2 and D5. The anodes of the indicating electro-luminescent devices LD3 and LD6 are electrically connected to be the anode voltage VB. The gamma curve of blue light pixel electro-luminescent devices is then adjusted based on the cross voltage between the anode voltage VB and the common cathode voltage VSS, which reflects the total blue light brightness decrease of the pixel electro-luminescent devices electrically connected to the data lines D2 and D5. By adjusting the gamma curves of the red, green, and blue lights in color-shift compensation unit 210, a gamma curve converter 220 transforms digital pixel data PD1-PD6 to appropriate analog pixel data based on the adjusted gamma curves. As a result, the brightness levels of pixel electro-luminescent devices of different colors are brought back to their original levels or to the same level.

Figure 3:
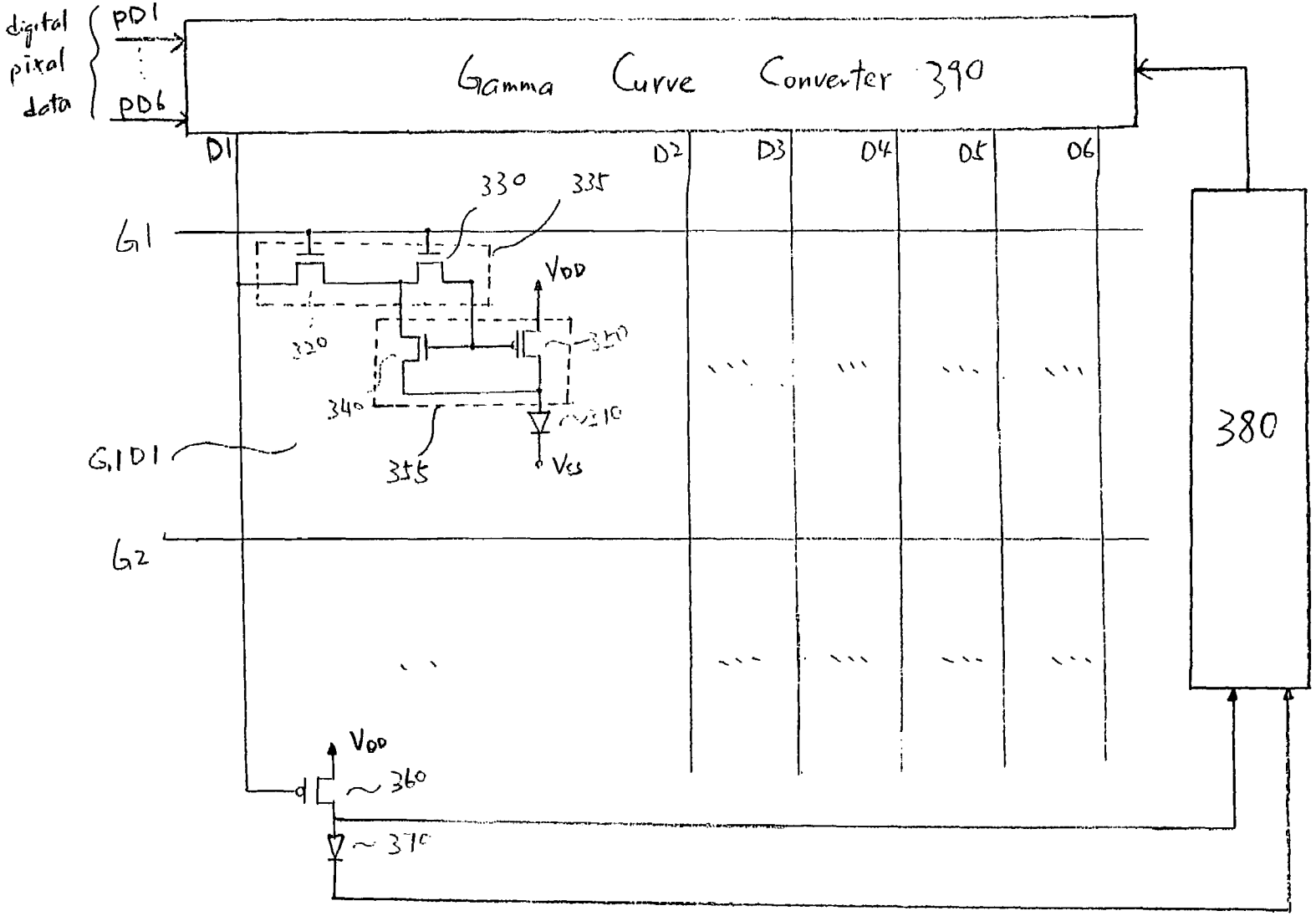
FIG. 3 illustrates an exemplary embodiment of an electro-luminescent display with pixel electro-luminescent devices driven by current.

FIG. 3 illustrates another embodiment in which pixel electro-luminescent devices are driven by current. In a pixel region G1D1, a switch circuit 335 is electrically connected to the data line D1 and the scanning line G1; a pixel driving circuit 355 is electrically connected to the switch circuit and a pixel electro-luminescent device 310. Other pixel regions have a similar structure and circuit design. The pixel electro-luminescent devices connected to the same data line have the same color type. Three adjacent data lines can electrically connect to the pixel electro-luminescent devices of red, green, and blue colors.

The switch circuit 320 comprises a first switch device 320 and a second switch device 330. The first and second switch devices are thin film transistors (TFTs) in this embodiment. The pixel driving circuit 355 comprises a first pixel driving device 340 and a second pixel driving device 350. The first and second pixel driving devices are thin film transistors (TFTs) in this embodiment. The second pixel driving device is a p-type MOS TFT. A drain of the first switch device 320 is electrically connected to the data line D1; a gate of the first switch device 320 is electrically connected to the scan line G1; a source of the first switch device 320 is electrically connected to a drain of the second switch device 330 and a drain of the first pixel driving device 340. A gate of the second switch device 330 is electrically connected to the scan line G1; a source of the second switch device 330 is electrically connected to the gates of the first and second pixel driving devices 340 and 350. A source of the first pixel driving device 340 is electrically connected to an anode of the pixel electro-luminescent device 310 and a drain of the second pixel driving device 350. A source of the second pixel driving device 350 is electrically connected to the power supply line VDD. A drain of the second pixel driving device 350 is electrically connected to an anode of the pixel electro-luminescent device 310. A cathode of the pixel electro-luminescent device 310 is connected to the common electrode VSS. One of ordinary skill in the art will understand various different ways to drive pixel electro-luminescent device 310 by current.

In FIG. 3, each data line is electrically connected to an indicating driving circuit which is electrically connected to an indicating electro-luminescent device. The indicating driving circuit comprises an indicating driving device 360 which is a p-type MOS TFT. A gate of the indicating driving device 360 is electrically connected to the data line D1; a source of the indicating driving device 360 is electrically connected to the power supply line VDD; a drain of the indicating driving device 360 is electrically connected to an anode of the indicating electro-luminescent device 370. A cathode of the indicating electro-luminescent device 370 is electrically connected to the common electrode VSS. The indicating electro-luminescent device 370 is an organic light-emitting diode in this embodiment.

As mentioned above, the anodes and cathodes of the indicating electro-luminescent devices are electrically connected to a color-shift compensating unit 380. The gamma curves of different colors are adjusted based on the cross voltages between anodes and cathodes of the indicating electro-luminescent devices to compensate for the color shift effect. Thus, a gamma curve converter 390 transforms the digital pixel data PD1-PD6 into appropriate analog pixel data according to the adjusted gamma curves.

Figure 4:
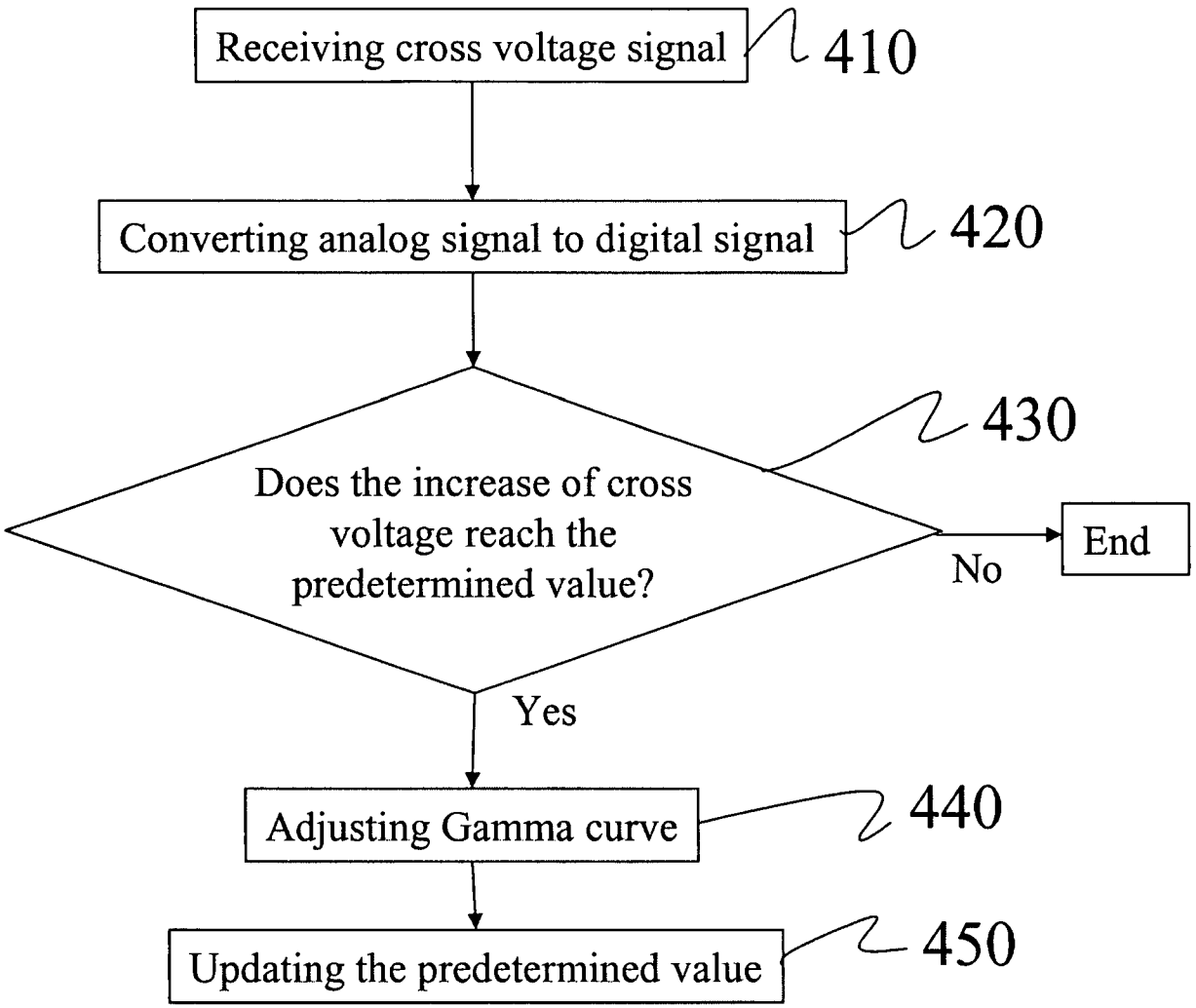
FIG. 4 illustrates an exemplary embodiment of a method to compensate the color shift effect by adjusting a gamma curve.

FIG. 4 illustrates an exemplary embodiment of a method to compensate for color shift in an electro-luminescent display. At step 410, cross voltage signals between anodes and cathodes of the indicating electro-luminescent devices in red, green, and blue color are received. For example, a voltage detector can be used to receive voltage signals from anodes and cathodes of the indicating electro-luminescent devices. At step 420, the cross voltage signals in analog form are converted into digital form by, for example, a digital analog converter. At step 430, the cross voltage signals are compared with predetermined values. If the differences between cross voltage signals and predetermined values reach threshold values for adjustment, the gamma curves are adjusted at step 440. As a result, in order for the pixel electro-luminescent devices to have the intended brightness, a specific digital pixel datum is transformed to a lower analog pixel datum according to the adjusted gamma curve, if p-type MOS transistors are used for the indicating driving circuit and the pixel driving circuit.

In some circumstances of prolonged usage, the pixel electro-luminescent devices may not be able to emit lights at the original brightness by adjusting a gamma curve. Another approach to compensate color shift is to even the brightness of pixel electro-luminescent devices of different colors, although the brightness may be lower than the original. Thus, for example, if the blue color OLEDs have decayed too much to restore to its original brightness solely by the adjustment of blue light gamma curve, the gamma curves of red light and green light may have to be adjusted with reference to the extent of blue color OLEDs' decay to even the brightness of different colors.

If the increase of the cross voltage reaches the predetermined value, the gamma curve is adjusted at step 440. At step 450, the detected cross voltage value is used to update the predetermined value. If the increase of the cross voltage is less than the predetermined value, the process cycle ends because the decay of pixel electro-luminescent devices is still tolerable. A new process cycle begins again at step 410 to receive a cross voltage signal.

Figure 5B:
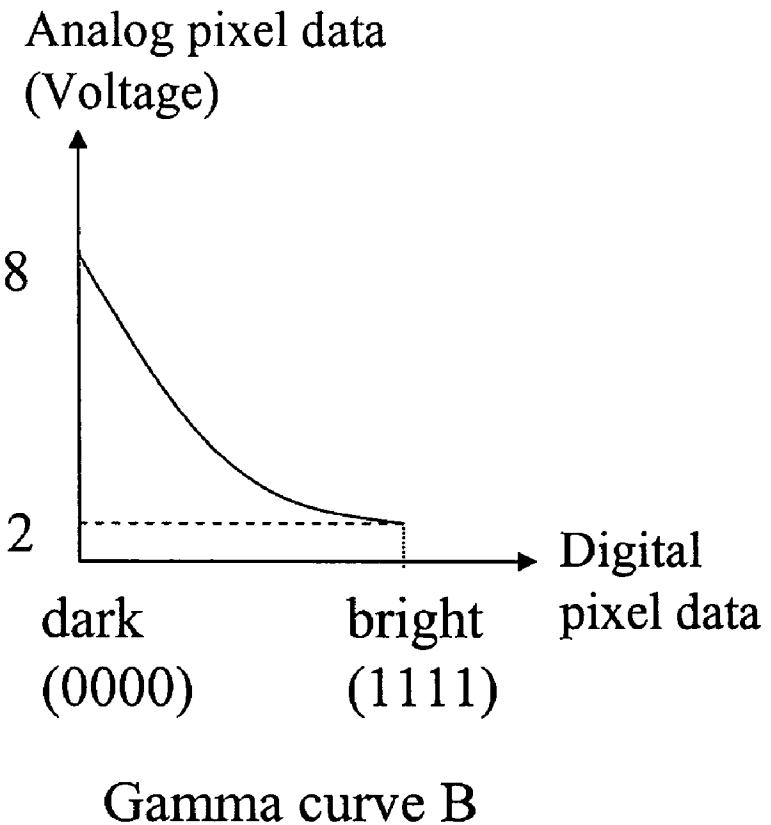
FIGS. 5A and 5B illustrate a gamma curve adjustment based on an increase of the cross voltage of the indicating electro-luminescent device.
Figure 5A:
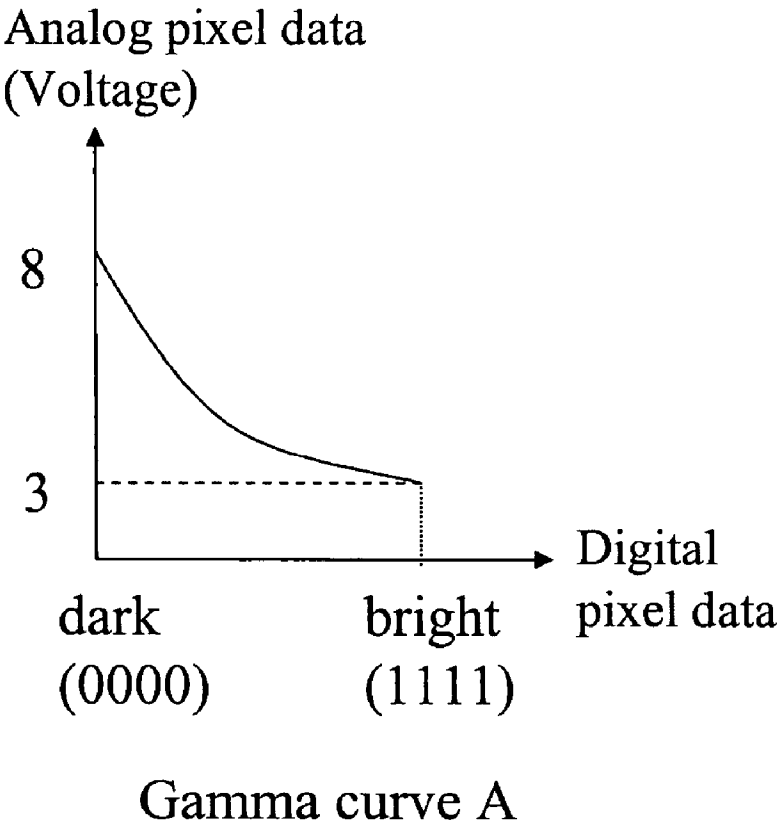

FIG. 5A shows a gamma curve A through which the digital pixel datum 0000 (dark) is transformed to the analog pixel datum 8V and the digital pixel datum 1111 (bright) is transformed to the analog pixel datum 3V. The gamma curve A is adjusted to the gamma curve B as shown in FIG. 5B when the increase on the cross voltage reaches the predetermined value. Applying the gamma curve B, the digital pixel datum 1111 (bright) is transformed to the analog pixel datum 2V, rather than 3V in the gamma curve A, to bring out the intended brightness.

Figure 6:
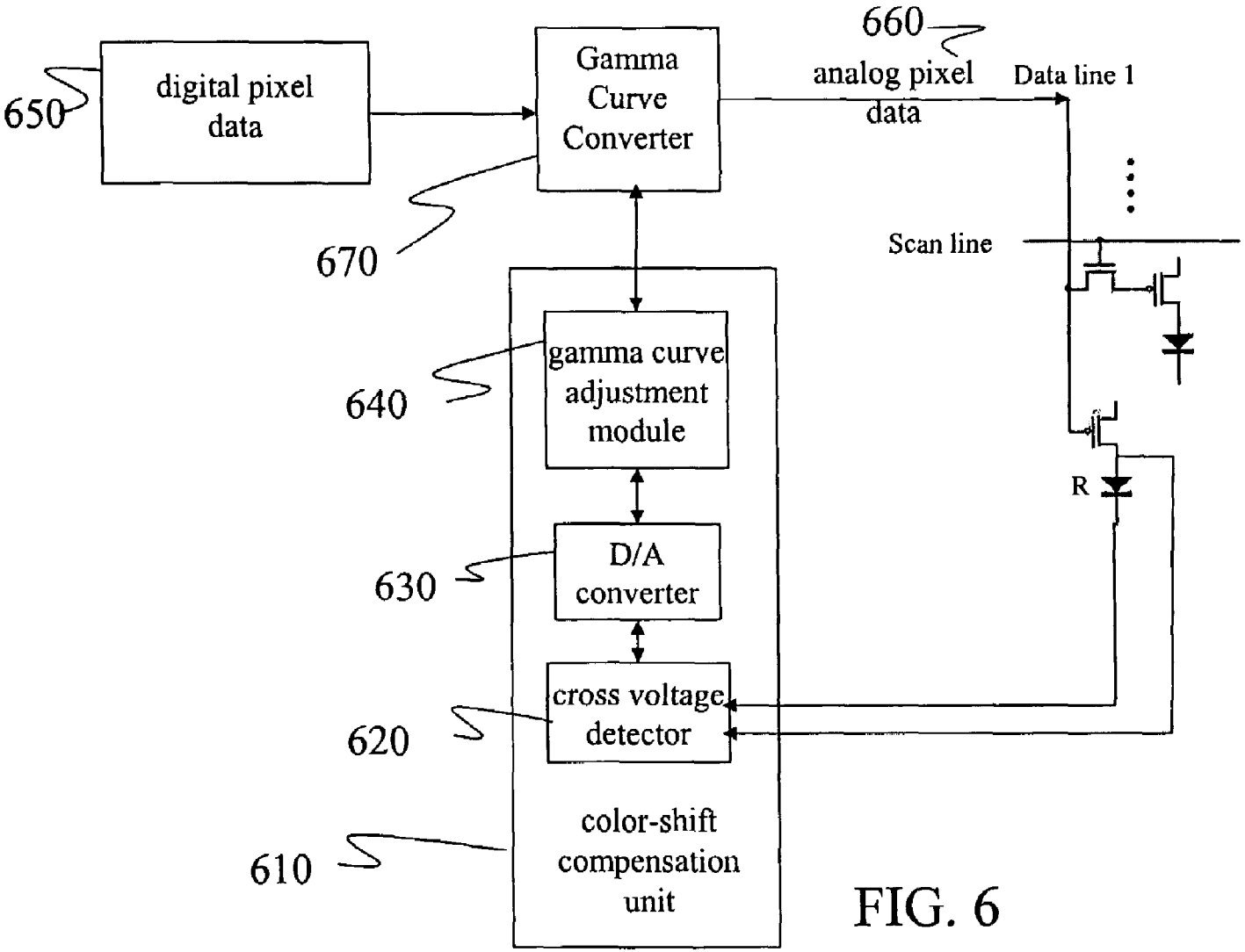
FIG. 6 illustrates an exemplary embodiment of a color-shift compensation unit used in an electro-luminescent display.

In FIG. 6, an exemplary embodiment of a color-shift compensation unit 610 comprises a cross voltage detector 620, a digital analog converter 630, and a gamma curve adjustment module 640. The cross voltage detector 620 receives voltage signals from the anode and cathode of the indicating electro-luminescent device. The analog cross voltage signal is transformed to its digital form by the digital analog converter 630. In the gamma curve adjustment module 640, the increase of the cross voltage is compared to the predetermined value; the gamma curves of different colors are adjusted; and the predetermined value is updated. Based on the adjusted gamma curves, a gamma curve converter 670 then transforms the digital pixel data 650 into the analog pixel data 660 which are used to drive the pixel electro-luminescent devices without color shift effect. Skilled artisans will appreciate other hardware structures inside the color-shift compensation unit 610 to compensate for color shift by adjusting the gamma curves.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. An electro-luminescent display, comprising:

a plurality of scanning lines;

a plurality of data lines which are arranged to cross the plurality of scanning lines and forming a plurality of pixel regions;

wherein each of the pixel regions includes a switching circuit, a pixel driving circuit, and a pixel electro-luminescent device having a color type, the switching circuit being electrically connected to a respective one of the scanning lines and a respective one of the data lines, ones of the pixel electro-luminescent devices electrically connected to one of the data lines having the same color type as each other;

at least one indicating driving circuit, distinct from the pixel driving circuits, the indicating driving circuit electrically connected to the one data line and controlled by a signal thereon; and at least one indicating electro-luminescent device electrically connected to and driven by the indicating driving circuit and having the same color type as the pixel electro-luminescent device electrically connected to the one data line;

wherein the switching circuit comprises a first switching device and a second switching device, the pixel driving circuit comprises a first pixel driving device and a second pixel driving device; and wherein a drain of the first switching device is connected to the data line, a gate of the first switching device is connected to the scan line, a source of the first switching device is connected to a drain of the second switching device and a drain of the first pixel driving device, a gate of the second switching device is connected to the scan line, a source of the second switching device is connected to gates of the first pixel driving device and the second pixel driving device, a source of the first pixel driving device is connected to a drain of the second pixel driving device and an anode of the pixel electro-luminescent device, and a source of the second pixel driving device is connected to a power supply line.

2. The electro-luminescent display of claim 1, further comprising:

a color-shift compensation unit electrically connected to an anode and a cathode of the indicating electro-luminescent device.

3. The electro-luminescent display of claim 2, wherein the color-shift compensation unit comprises a cross voltage detector, a gamma curve adjustment module, and a digital analog converter.

4. The electro-luminescent display of claim 1, wherein the switching circuit and the pixel driving circuit are electrically connected to drive the pixel electro-luminescent device by current or by voltage.

5. The electro-luminescent display of claim 4, wherein the switching circuit comprises a switching device;

the pixel driving circuit comprises a pixel driving device;

wherein the switching device and the pixel driving device are electrically connected to drive the pixel electro-luminescent device by voltage.

6. The electro-luminescent display of claim 5, wherein the switching device and the pixel driving device comprise a thin film transistor.

7. The electro-luminescent display of claim 4, wherein the switching circuit comprises a first switching device and a second switching device;

the pixel driving circuit comprises a first pixel driving device and a second pixel driving device;

wherein the first switching device, the second switching device, the first pixel driving device and the second pixel driving device are electrically connected to drive the pixel electro-luminescent device by current.

8. The electro-luminescent display of claim 7, wherein the first switching device, the second switching device, the first pixel driving device, and the second pixel driving device comprise a thin film transistor.

9. An electro-luminescent display, comprising:

a plurality of scanning lines;

a plurality of data lines which are arranged to cross the plurality of scanning lines and forming a plurality of pixel regions;

wherein each of the pixel regions includes a switching circuit, a pixel driving circuit, and a pixel electro-luminescent device having a color type, the switching circuit being electrically connected to a respective one of the scanning lines and a respective one of the data lines, ones of the pixel electro-luminescent devices electrically connected to one of the data lines having the same color type as each other;

at least one indicating driving circuit, distinct from the pixel driving circuit, the indicating driving circuit electrically connected to the one data line and controlled by a signal thereon; and at least one indicating electro-luminescent device electrically connected to and driven by the indicating driving circuit and having the same color type as the pixel electro-luminescent device electrically connected to the one data line;

wherein the switching circuit and the pixel driving circuit are electrically connected to drive the pixel electro-luminescent device by current or by voltage;

wherein the switching circuit comprises a first switching device and a second switching device;

wherein the pixel driving circuit comprises a first pixel driving device and a second pixel driving device;

wherein the first switching device comprises a first thin film transistor, the second switching device comprises a second thin film transistor, and the first pixel driving device and the second pixel driving device comprise thin film transistor; and wherein a drain of the first thin film transistor is connected to the data line, a gate of the first thin film transistor is connected to the scan line, a source of the first thin film transistor is connected to a drain of the second thin film transistor and a drain of the first pixel driving device, a gate of the second thin film transistor is connected to the scan line, a source of the second thin film transistor is connected to gates of the first pixel driving device and the second pixel driving device, a source of the first pixel driving device is connected to a drain of the second pixel driving device and an anode of the pixel electro-luminescent device, a source of the second pixel driving device is connected to a power supply line.

10. The electro-luminescent display of claim 1, wherein the indicating driving circuit comprises an indicating driving device.

11. The electro-luminescent display of claim 10, wherein the indicating driving device comprises a thin film transistor.

12. The electro-luminescent display of claim 1, wherein the pixel electro-luminescent devices are electrically connected to three adjacent ones of the data lines include red, green, and blue color types.

13. The electro-luminescent display of claim 1, wherein the at least one indicating driving circuit has a plurality of indicating driving circuits electrically connected to the respective data line and controlled by a signal thereon; and the at least one indicating electro-luminescent device has a plurality of indicating electro-luminescent devices electrically connected to and driven by the indicating driving circuit and having the same color type as the pixel electro-luminescent device electrically connected to the respective data line.

14. The electro-luminescent display of claim 13, further comprising:

a color-shift compensation unit electrically connected to a plurality of anodes and cathodes of the indicating electro-luminescent devices.

15. The electro-luminescent display of claim 14, wherein the plurality of anodes of the indicating electro-luminescent devices of the same color type are electrically connected.

16. The electro-luminescent display of claim 13, wherein the color-shift compensation unit comprises a cross voltage detector, a digital analog converter, and a gamma curve adjustment module.

17. A method to compensate color-shift in an electro-luminescent display having a plurality of pixel electro-luminescent devices, comprising:

providing an indicating driving circuit, distinct from a pixel driving circuit, electrically connected to a data line;

providing an indicating electro-luminescent device, distinct from the pixel electro-luminescent devices, electrically connected to the indicating driving circuit; and driving the indicating electro-luminescent device when any of the pixel electro-luminescent devices electrically connected to the data line is driven;

wherein the switching circuit comprises a first switching device and a second switching device, the pixel driving circuit comprises a first pixel driving device and a second pixel driving device; and wherein a drain of the first switching device is connected to the data line, a gate of the first switching device is connected to the scan line, a source of the first switching device is connected to a drain of the second switching device and a drain of the first pixel driving device, a gate of the second switching device is connected to the scan line, a source of the second switching device is connected to gates of the first pixel driving device and the second pixel driving device, a source of the first pixel driving device is connected to a drain of the second pixel driving device and an anode of the pixel electro-luminescent device, and a source of the second pixel driving device is connected to a power supply line.

18. The method of claim 17, further comprising:

receiving a cross voltage signal between an anode and cathode of at least one indicating electro-luminescent device; and adjusting a gamma curve based on the cross voltage signal.

19. The method of claim 18, further comprising:

converting the cross voltage signal from an analog form into a digital form;

comparing the cross voltage signal of the digital form with a predetermined value; and updating the predetermined value.

20. The method of claim 18, further comprising:

receiving the cross voltage signals from a plurality of the indicating electro-luminescent devices of the same color; and adjusting a gamma curve of the same color based on the cross voltage signals.

* * * * *